United States Patent [19]

Kästingschäfer et al.

[11] Patent Number: 4,973,001

[45] Date of Patent: Nov. 27, 1990

[54] MATERIAL BED ROLLER MILL

[75] Inventors: Gerhard Kästingschäfer, Wadersloh; Reinhold Gebbe, Sessenberg; Gerhard Arensmeier, Beckum, all of Fed. Rep. of Germany

[73] Assignee: Krupp Polysius AG, Fed. Rep. of Germany

[21] Appl. No.: 337,387

[22] Filed: Apr. 13, 1989

[30] Foreign Application Priority Data

May 3, 1988 [DE] Fed. Rep. of Germany ..... 3815002

[51] Int. Cl.[5] ..... B02C 4/32

[52] U.S. Cl. ..... 241/37; 72/245; 100/47; 100/170; 241/231

[58] Field of Search ..... 241/37, 230, 231, 234, 241/239, 259, 259.2; 72/245; 100/46, 47, 168, 170

[56] References Cited

U.S. PATENT DOCUMENTS

| | | | |
|---|---|---|---|
| 2,204,434 | 6/1940 | Munson | 100/170 |
| 2,862,360 | 12/1958 | Audemar | 100/170 X |
| 3,527,159 | 9/1970 | Edwards | 100/170 |
| 3,733,870 | 5/1973 | Diolot | 72/245 |
| 4,154,160 | 5/1979 | Küsters | 100/170 X |
| 4,299,162 | 11/1981 | Hartmann et al. | 100/170 X |

*Primary Examiner*—Joseph M. Gorski

*Attorney, Agent, or Firm*—Learman & McCulloch

[57] ABSTRACT

The invention relates to a material bed roller mill with a fixed roller and a floating roller which between them form a grinding gap and a hydraulic-pneumatic spring system which presses the floating roller in the direction of the fixed roller and contains at least one hydraulic working cylinder and a working pneumatic spring which cooperates therewith for each side of the floating roller. The spring container of each working pneumatic spring is divided by two movable pistons into a central gas filling chamber and two opposing hydraulic fluid chambers, and a stroke measuring device is associated with one piston for the preliminary filling pressure of the hydraulic fluid. In this way it is possible to reset the grinding force during operation by means of the hydraulic pressure with the same pneumatic spring characteristic on both sides of the floating roller.

11 Claims, 2 Drawing Sheets

MATERIAL BED ROLLER MILL

The invention relates to a material bed roller mill for the comminution under pressure of brittle material for subsequent grinding wherein the comminution pressure may be adjusted in response to changing conditions even during continuous mill operation.

BACKGROUND OF THE INVENTION

Material bed roller mills are quite generally known for instance from DE-C No. 27 08 053 and facilitate a considerable saving of energy in the comminution under pressure of brittle material for grinding, such as for example cement clinker, ores etc. In such material bed roller mills two driven rollers which are arranged horizontally adjacent to one another are pressed against one another at high pressure. When the material passes through the grinding gap between the two rollers it is comminuted to a large extent, and agglomerates (lumps) are formed which contain a high proportion of fine or finished material and are then broken up in a subsequent machine with a low energy consumption.

Of the two rollers of such a material bed roller mill one roller is constructed as a fixed roller which is mounted stationary and the other is constructed as a floating roller which is mounted so as to be movable at right angles to the grinding gap, and the floating roller is sprung and pressed at high pressure in the direction of the fixed roller in order to bring about the comminution under pressure of the material for grinding as explained above. In order to produce this high pressure it is known in the art for a combined hydraulic/pneumatic spring system to be arranged on each side of the floating roller, in which at least one hydraulic working cylinder which co-operates with a working pneumatic spring is provided for each side of the floating roller, i.e. for each axle neck of the floating roller. With the aid of these hydraulic/pneumatic spring systems the optimum grinding force should be set in the grinding gap by means of the floating roller and the desired pneumatic spring characteristic (rigidity of the spring) should also be set.

In this construction which is known in the art the optimum setting particularly of the grinding force is achieved above all by a number of tests in which different settings for the preliminary filling pressures of the gas and hydraulic fluid are tried, and each time the roller mill has to be switched off and a new preliminary filling pressure set. During the setting operation the working pneumatic spring which is present in each hydraulic/pneumatic spring system is first of all filled with gas to a predetermined preliminary gas filling pressure, and then the hydraulic oil is fed in to a predetermined preliminary filling level in order to set the grinding force with a so-called zero gap, that is to say when the flux of force between the two rollers runs over a plurality of spacers by means of which a minimum roller spacing is maintained. The pneumatic spring characteristic and the grinding force behaviour during the comminution of the material for grinding are determined by the preliminary gas and oil filling pressures. In the known material bed roller mills which are constructed in this way it is not possible to adjust the pressure in the hydraulic-pneumatic spring system directly in case of need (for example by delivery and removal of hydraulic oil) especially as the spring characteristics of the pneumatic springs on both sides of the floating roller should be identical after the adjustment, and therefore it is always necessary to switch off the roller mill for each adjustment and then restart it.

The object of the invention, therefore, is to make further developments to a material bed roller mill in such a way that using relatively simple measures the grinding force can be adjusted in a simple manner, even during mill operation, and thus can be adapted to changed comminution conditions.

SUMMARY OF THE INVENTION

In the material bed roller mill according to the invention the hydraulic-pneumatic spring systems and particularly the appertaining working pneumatic springs have been modified. The spring container of each working pneumatic spring is divided by the construction according to the invention into a central gas filling chamber (between the two pistons) and two hydraulic fluid chambers which are associated with the two end sections of the container and are essentially variable in response to selected operating pressures. It is of further significance that in each case a stroke measuring device which responds to the piston movement is associated with the piston defining the second hydraulic fluid chamber, and by means of this stroke measuring device the preliminary filling pressure of the hydraulic fluid can be adjusted during operation to obtain the same pneumatic spring characteristic on both sides of the floating roller (that is to say in both hydraulic-pneumatic spring systems). Thus by means of each working pneumatic spring the preliminary hydraulic fluid filling pressure and thus also the grinding force in the grinding gap of the roller mill can be accurately adjusted in the desired manner during the comminution operation by means of the stroke measuring device provided in such a way that the optimal grinding force and thus the optimal material comminution action of the roller mill are controlled or regulated. This can take place during the starting up of the roller mill, when the material for grinding is changed, upon alteration of the material parameters (e.g. proportion of fines, moisture content, etc.) and also in the case of any necessary resetting of the floating roller in the case of severe wear of the grinding rollers. Such a readjustment of the grinding force can be carried out for example both directly by hand or also electromagnetically from a control center or via a control circuit. By means of the construction of the working pneumatic springs according to the invention the previously explained control or regulation of the grinding force (via the preliminary filling pressure of the hydraulic fluid) can be carried out independently of fluctuations in each hydraulic-pneumatic spring system which are attributable to a horizontal movement of the floating roller and also independently of the position of the floating roller (e.g. inclined position), as a result of which the pneumatic spring operational charateristics remain substantially identical even after a readjustment of the grinding force via the preliminary hydraulic filling pressure in the working pneumatic springs on each side of the floating roller.

It is also possible for the load occurring as a result of the grinding force to be limited to a maximum permitted level or set in a particularly advantageous manner without it being necessary to switch off the roller mill. For this purpose a pressure-limiting valve is connected to the second hydraulic fluid chamber of the working pneumatic spring for the setting of the maximum permissible grinding force in the grinding gap. This represents a particularly simple and at the same time effective measure with regard to overstressing of at least some parts of the roller mill.

THE DRAWINGS

The invention will be explained in greater detail below with the aid of the drawings, in which.

DETAILED DESCRIPTION

Figure 1:
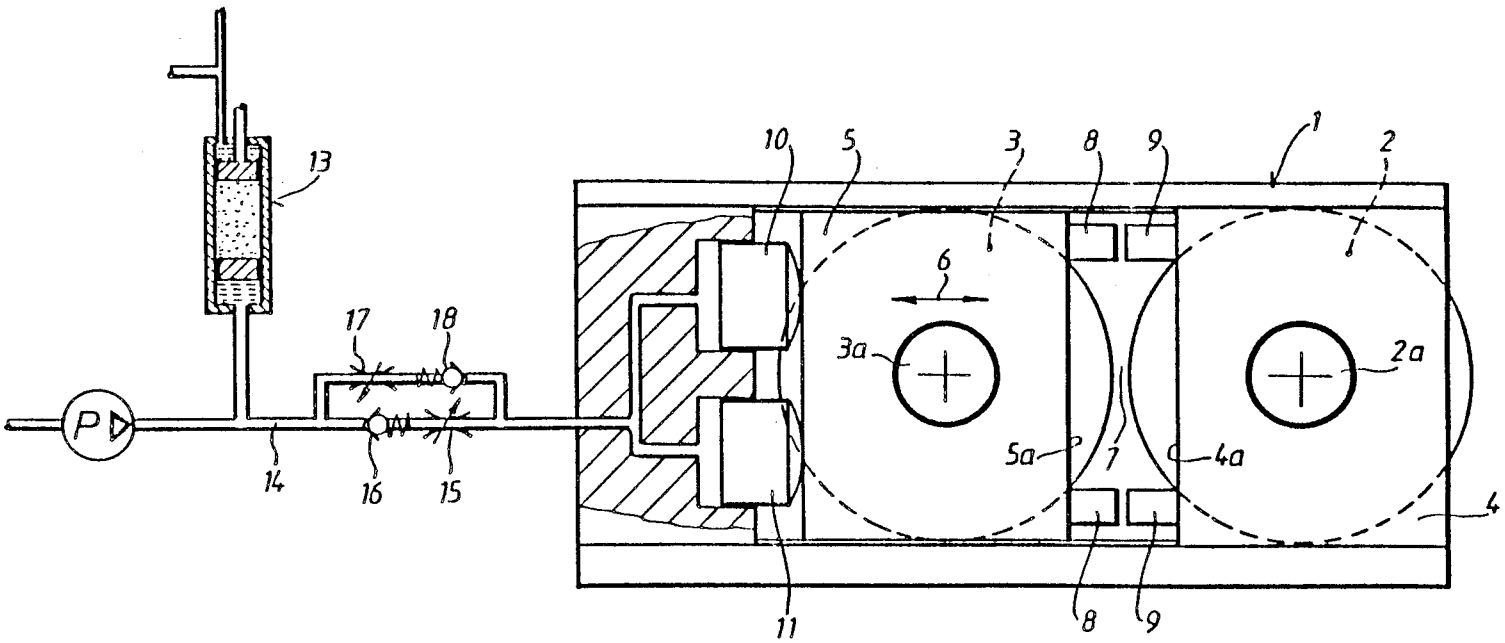
FIG. 1 shows a schematic side view of the material bed roller mill.

First of all the general construction of the material bed roller mill will be explained with the aid of FIG. 1. In a mill housing 1 which is to be set up in a fixed position this material bed roller mill contains two horizontal rollers 2, 3 which are driven by drive means which are not illustrated in detail and are known per se, of which the roller 2 is constructed as a fixed roller and the roller 3 as a floating roller. The fixed roller 2 is mounted by means of its two axle necks 2*a* in two appertaining bearing jewels 4 so that it is stationary in the mill housing, whilst the two axle necks 3*a* of the floating roller 3 are mounted in two appertaining floating bearing jewels 5 which are movable according to the double arrow 6 inside the mill housing 1 together with the floating roller 3 so that the latter is movable or displaceable relative to the fixed roller 2. A grinding gap (roller gap) 7 is formed between the two rollers 2, 3. Since the floating roller 3 is movable in the direction of the double arrow 6 it is also movable at right angles to the grinding gap 7, i.e. the width of this grinding gap 7 can be altered appropriately by the movability of the floating roller 3.

A plurality of spacers in the form of distance pieces 8, 9 which determine the minimum roller spacing by reciprocal abutment are mounted on the opposing end faces 4*a* and 5*a* of the bearing jewels 4, 5 respectively; this minimum roller spacing ensures that during no-load running of the roller mill, that is to say when no material or only a small quantity is being delivered, the two rollers 2, 3 do not rest against one another with their roller surfaces, thus preventing unnecessary wear. This minimum roller spacing represents the so-called zero gap.

In order to press the floating roller 3 with the necessary high pressure in a sprung manner in the direction of the fixed roller 2, a hydraulic-pneumatic spring system is provided for each side of the floating roller 3; in the embodiment illustrated in FIG. 1 each hydraulic-pneumatic spring system contains two hydraulic working cylinders 10, 11, a hydraulic pump 12 and a working pneumatic spring 13 which is connected by a hydraulic pipe 14 to the two working cylinders 10, 11.

A first throttle 15 with which a first non-return valve is connected in series can be arranged in the hydraulic pipe 14. A second throttle 17 with which a second non-return valve 18 is connected in series is arranged parallel to the first series connection. This co-ordination of the two throttles 15, 17 and the two non-return valves 16, 18 prevents the occurrence of disruptive resonant vibrations.

It should also be emphasised that instead of two working cylinders 10, 11 on each side of the floating roller 3 it is also possible for only one such working cylinder to provided in each case; however, the arrangement of two working cylinders 10, 11 according to FIG. 1 ensures a tilt-free adjustment of the appertaining floating bearing jewels 5 (of the floating roller 3).

One of the hydraulic-pneumatic spring systems of the material bed roller mill according to FIG. 1 will be explained in greater detail below with the aid of the flow diagram according to FIG. 2, in which for the sake of simplicity only one working cylinder, for example the working cylinder 10, and the floating roller 3 with its associated floating bearing jewel 5 is shown (on one side or on one axle neck 3*a* of the floating roller 3). The movability of the floating roller 3 with the aid of its floating bearing jewels 5 is in turn illustrated by the double arrow 6, while the grinding force which is necessary for comminution of the material for grinding in the grinding gap between the two rollers is indicated by an arrow 19 directed towards the floating roller.

The working pneumatic spring 13 which is involved in the illustrated hydraulic-pneumatic spring system on one side of the floating roller is connected by the pipe 14 to the working cylinder, e.g. 10, and has an elongated spring container 20 approximately like a cylinder which is substantially closed on both end sections by walls 20*a*, 20*b*—apart from sealed lead-in pipes or the like. In addition, inside the spring container 20 this working pneumatic spring 13 has two pistons 21, 22 which are movable relative to one another and are each associated with one end section of the container. As can be seen in FIG. 2, the opposing sides of these two pistons 21, 22 define a central gas filling chamber 23 of the pneumatic spring 13, while the opposing sides of the pistons facing end walls 20*a* and 20*b* respectively of the spring container 20 define a first hydraulic fluid chamber 24 and a second hydraulic fluid chamber 25. The first hydraulic fluid chamber 24 defined by the first piston 21 is connected by the hydraulic pipe 14 to the hydraulic working cylinder, e.g. 10.

The two pistons 21 and 22 can basically be constructed in each case in the form of a piston plate or a piston body. However, a stroke measuring device which responds to movements of the piston in one or the other direction is associated with the second piston 22 and in general terms is constructed in any suitable manner and associated with this second piston 22 in such a way that it responds to each of the back and forth movements of the piston and measures their extent. One possibility for the construction of such a stroke measuring device is indicated in FIG. 2 at 26. For this the second piston 22 has a piston rod 22*a* which projects outwards through the adjacent end wall 20*b* of the spring container 20 and co-operates with the stroke measuring device 26 for accurate determination of each change in position of the piston 22 in the spring container 20.

Another embodiment of a stroke measuring device (not shown) which is structurally particularly simple as well as being very advantageous in use from the point of view of control and regulation can consist of an ultrasonic measuring device which responds to each change in the position of the second piston 22 in the spring container 20. For this a transmitter and receiver for example could be provided in or on the adjacent end wall 20*b* of the spring container 20 in such a way that corresponding signals from which the exact relative position of the piston 22 in the spring container 20 can be deduced are reflected by the piston 22.

The preliminary hydraulic fluid filling pressure of the working spring 13 can be measured by such a stroke measuring device and during the mill operation it can be set to establish an approximately equal pneumatic spring characteristic on both sides of the floating roller 3 and thus the grinding force in the grinding gap can be simultaneously set, as will be explained in greater detail below.

A pressure-limiting valve 28 by means of which a maximum permissible grinding force in grinding gap 7 can be set or controlled is also connected to the second hydraulic fluid chamber 25 of the spring container 20. The discharge side of this pressure-limiting valve is connected to a hydraulic fluid tank 29. It should be emphasised in this connection that any suitable hydraulic fluid can be used; however, it is preferably hydraulic oil.

A branch pipe 30 is also joined to the pipe 27 connected to the second hydraulic fluid chamber 25 and is connected by an oil feed pump 31 to the oil tank 29, and a multi-way/multi-position valve 32 which clears the way for hydraulic fluid to be delivered to and removed from the second hydraulic fluid chamber 25 is arranged as well as a manometer 33 in the branch pipe 30.

A branch pipe 34 in which a further multi-way/multi-position valve 35 which permits the delivery and removal of hydraulic fluid and a manometer 36 are arranged is also joined to the hydraulic pipe 14 connected to the first hydraulic fluid chamber 24 of the spring container 20 and is also connected to the oil tank 29 by the oil feed pump 31.

The delivery of gas to the gas filling chamber 23 of the spring container 20 can be carried out in any suitable manner. In the example according to FIG. 2 the piston rod **22*a* can be constructed as a hollow rod and connected to a gas delivery pipe 37. However, although not shown, it is equally possible and structurally very much more favourable for the gas delivery to the gas filling chamber 23 to be carried out through a supply hose which is spirally or helically coiled and can be arranged inside the second hydraulic fluid chamber 25 without impeding the relative movements of the second piston 22**. In the latter case it is not necessary to have a piston rod coming out of the spring container, which then favors the use of an ultrasonic measuring device for the stroke measurement.

In either case the gas delivery pipe 37 is still provided and is connected for instance by a manometer 39 and a further multi-way/multi-position valve 40 as well as a simple shut-off valve 41 to a compressed gas source which can be constructed for example as a compressed gas bottle 38.

It can also be advantageous if an auxiliary pneumatic spring 42 is also connected to the hydraulic pipe 14 leading from the first hydraulic fluid chamber 24 of the spring container 20 to the working cylinder and the spring force of the auxiliary pneumatic spring 42 is adapted to provide the restoring force for the floating roller 3 in the zero gap position determined by the spacers 8, 9; this additional auxiliary pneumatic spring will therefore be designated below as the zero gap pneumatic spring 42.

The zero gap pneumatic spring can be of markedly simpler construction than the working pneumatic spring 13. It has a substantially closed and preferably cylindrical spring container 43 and a simple piston 44 (e.g. a plate piston or a diaphragm piston) which is arranged therein so as to be axially movable and divides the interior of the container into a gas filling chamber 45 and a hydraulic fluid chamber or oil chamber 46. The oil chamber 46 is joined by a connecting pipe **14*a* to the hydraulic pipe 14, while the gas filling chamber 45 is also connected to the compressed gas bottle 38 by a gas pipe 47. A multi-way/multi-position valve 48 and a manometer 49 are again installed in the gas pipe 47**.

This zero gap pneumatic spring 42 is constructed and arranged in a special manner to co-operate with the working pneumatic spring 13 which is provided here. For this purpose the rollers 2, 3 are relieved of pressure on the part of the working pneumatic spring 13 when the supply of material to the grinding gap 7 is interrupted. In this pressure-relieved no-load running state the two rollers 2, 3 should be brought together again into their starting position, that is to say the zero gap position, with the floating roller 3 being guided by its floating bearing jewels 5 against the fixed roller 2 until the spacers 8, 9 butt against one another. In order to accomplish this return in the pressure-relieved state the zero gap pneumatic spring 42 becomes effective, and its spring force must be only so great that the corresponding frictional forces are overcome and the floating bearing jewels 5 together with the floating bearing 3 can be put back. This simple measure means that the corresponding components of the roller mill can be reduced both in weight and in machining costs by comparison with the previously known mills and also that during interruptions or no-load running no undesirably large shocks are exerted on the corresponding components of the mill and because of these relatively low stresses the operational life in particular of the bearings (self-aligning roller bearings) and possibly the bearing jewels can be extended.

The following should also be noted with regard to the functioning in particular of the hydraulic pneumatic spring system for the floating roller 3:

First of all it may be assumed that the preliminary gas and oil filling pressures are set at the zero gap position (spacers 8, 9 butt against one another). In this connection a study of the flow diagram in FIG. 2 will show that first of all the valves 32, 35 are opened and the preliminary gas filling pressure in the gas filling chamber 23 of the working pneumatic spring 13 is set at the necessary pressure via the gas delivery pipe 37 as well as the valve 40 and the manometer 39 and thereupon the gas pressure in the zero gap pneumatic spring 42 is set at the necessary pressure via the gas pipe 47, valve 48 and manometer 49. Here the preliminary gas filling pressure of the working pneumatic spring 13 is generally markedly higher than that in the zero gap pneumatic spring 42 (for example, the preliminary gas filling pressure in the working pneumatic spring 13 can be approximately 40 bars and the gas pressure in the zero gap pneumatic spring 42 can be approximately 8 bars). After these gas pressures have been set the two oil valves 32, 35 are temporarily closed. After the oil feed pump 31 has been started, the preliminary oil filling pressure in the second hydraulic fluid chamber 25 of the working pneumatic spring 13 is first of all set via the oil valve 32 and then the preliminary oil filling pressure in the oil chamber 46 of the zero gap pneumatic spring 42 is set via the other oil valve 35, the preliminary oil filling pressure in the second hydraulic fluid chamber 25 being markedly higher than that in the oil chamber 46 of the zero gap pneumatic spring 42. The preliminary oil filling pressure in the oil chamber 46 of the zero gap pneumatic spring 42 must be lower than the preliminary gas or oil filling pressure in the working pneumatic spring 13. The hydraulic-pneumatic spring system is then ready to start.

Figure 2:
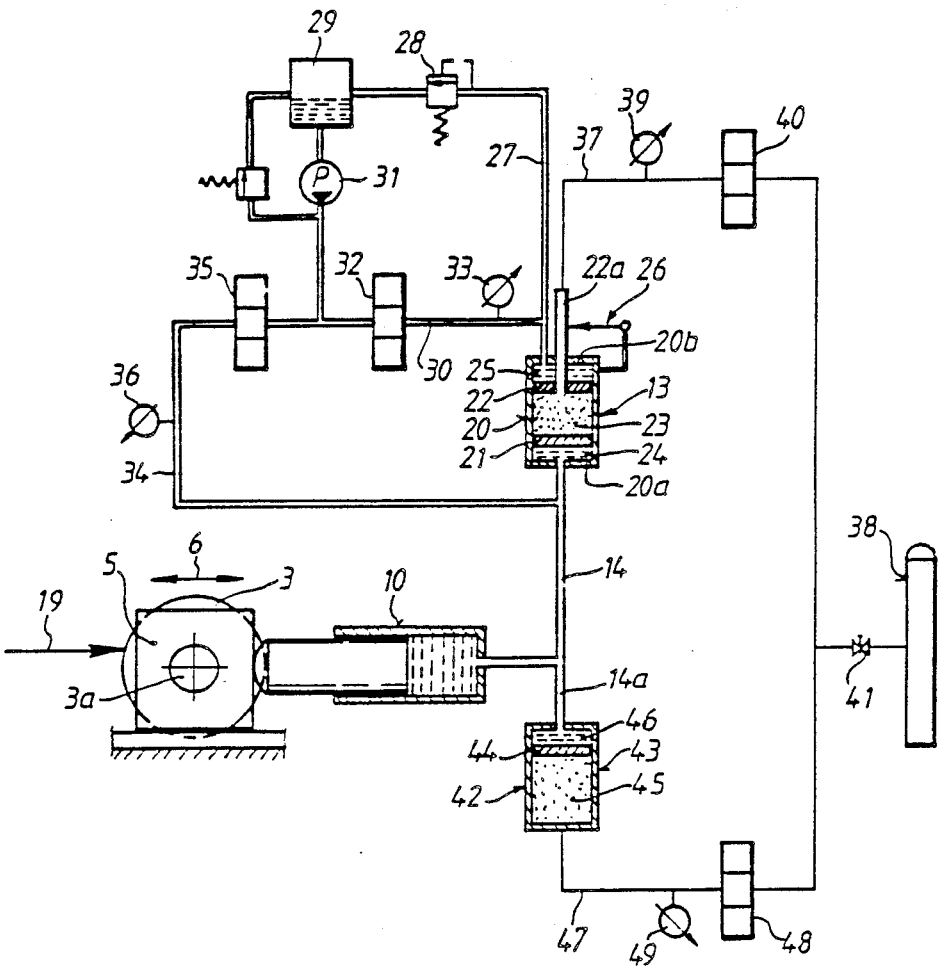
FIG. 2 shows a simplified flow diagram of a hydraulic-pneumatic spring system for one side of the floating roller.

With regard to the setting and control or regulation of the grinding force in the grinding gap it should again be pointed out that the floating roller 3 is moved by its two floating bearing jewels 5 which are each acted on by two working cylinders 10, 11 and a cooperating working pneumatic spring 13 of the corresponding hydraulic-pneumatic spring system (according to FIG. 2). However, these two hydraulic-pneumatic spring systems are decoupled, i.e. they work independently of each other at the same zero setting (same preliminary gas and oil filling pressures) of the working springs 13, so that depending upon the prevailing operating conditions, i.e. for example in the case of a differing delivery of material for grinding over the width of the rollers and thus in the case of an inclined position of the floating roller 3, the working pneumatic springs 13 of the two pressure systems can be loaded differently. The said zero position in both working pneumatic springs is necessary because the load profile of the rollers 2, 3 can be different depending upon the comminution situation, so that the same zero setting offers the greatest possibilities for equalization.

In the construction and assembly explained in particular with the aid of FIG. 2, with each working pneumatic spring 13 the preliminary oil filling pressure and thus the grinding force during operation of the roller mill can be adjusted in a defined manner via the stroke measuring device 26 which has already been explained, as a result of which the grinding force in the grinding gap 7 can be optimally controlled or regulated. With the aid of the stroke measuring device 26 the mean pressure on the two floating bearing jewels 5 can be optimally set with differing load over the width of the rollers 2, 3, and the preliminary oil filling pressures set initially for the working pneumatic springs 13 of both sides of the floating roller can be altered identically. By means of this stroke measurement via the second pistion 22 of the working pneumatic springs 13 the grinding force can always be reset in each operating phase if the comminution conditions in the roller mill have altered for example through alterations in the parameters of the material for grinding or if the floating roller 3 is reset in the event of excessive wear on the grinding rollers. These resettings or control adjustments can be carried out during operation without the roller mill having to be stopped for the purpose; the same naturally applies to the control or regulation at the beginning of operation.

In this material roller mill the hydraulic-pneumatic spring systems on both sides of the floating roller, and particularly the construction and function of the associated working pneumatic springs 13, work extremely favourably. Each working pneumatic spring 13 supplies a setting variable, namely the prevailing position of the second piston 22 in the spring container 20 (stroke measurement) with which the preliminary oil filling pressures in the appropriate hydraulic-pneumatic spring system on the corresponding side of the floating roller can be adjusted uniformly during the grinding operation. This means that the pneumatic spring characteristics are the same after readjustment in both hydraulic-pneumatic spring systems (on both sides of the floating roller). If one imagines a corresponding co-ordinate diagram on which the spring characteristic lines (for the spring characteristics) are plotted in a corresponding manner for different grinding gaps and grinding pressures, the the spring characteristic lines are the same even after adjustment of the two working pneumatic springs in the two hydraulic-pneumatic spring systems. With the previously mentioned setting variable (stroke measurement of the second piston of each working pneumatic spring) the grinding pressure (grinding force) in the grinding operation can be controlled or regulated by a comparison of actual and theoretical values for the specific comminution work. This means that with the newly created setting variable the material bed roller mill can always be regulated with constantly identical spring characteristic lines of the working pneumatic springs 13 of both hydraulic-pneumatic spring systems with the aid of the optimal operating point (specific comminution work).

Furthermore, the pressure-limiting valve 28 which is explained above and limits the maximum grinding force, thus preventing overloading of the roller mill, can be installed particularly advantageously in each hydraulic-pneumatic spring system. After this pressure-limiting valve 28 has responded (in the event of alteration in the preliminary oil filling pressure) the preliminary oil filling pressure can again be set to the optimum value by the aforementioned comparisons of actual and theoretical values without the roller mill having to be switched off after operation of the excess pressure valve.

What is claimed is:

1. A material bed roller mill for the comminution under pressure of brittle material for subsequent grinding, said mill comprising a pair of rollers arranged in cooperating relation to define a grinding gap therebetween, means for driving said rollers to comminute material introduced into said gap, first means mounting one of said rollers for rotation about a fixed axis, second means mounting the other of said rollers for rotation and for movement toward and away from said one roller, and adjustment means in operative association with said second mounting means to control movement of said other roller relative to said one roller, said adjustment means including a hydraulic-pneumatic spring system at each end of said other roller having at least one hydraulic working cylinder and a working pneumatic spring, said spring being formed from a single cylindrical container provided with a pair of pistons therein which are spaced from one another and from opposite ends of said container but are movable relative to one another, said pistons defining a gas chamber therebetween as well as a pair of spaced hydraulic fluid chambers with said opposite ends, gas supply means in communication with said gas chamer, hydraulic fluid supply means in communication with said hydraulic fluid chambers and with said hydraulic working cylinder, one of said hydraulic fluid chambers being in communication with said hydraulic working cylinder, and piston stroke measuring means operative with the other of said hydraulic fluid chambers and the piston defining said other of said hydraulic fluid chambers, whereby control of the operation of said systems relative to one another and to said gap is obtained.

2. The roller mill of claim 1 wherein roller zero gap defining means are provided at each end of said other roller which function to move said other roller into a predetermined minimum gap relationship with said one roller when said spring is inoperative.

3. The roller mill of claim 2 wherein said zero gap defining means includes a further pneumatic spring having a container confining a further movable piston therein and in communicaiton with both said gas and hydraulic fluid supply means on opposite sides of said further piston, the side of said further piston in communication with said hydraulic fluid supply means also being in communication with said at least one hydraulic working cylinder and one of said working pneumatic springs.

4. The roller mill of claim 1 wherein that portion of said hydraulic fluid supply means which is in communication with said other of said hydraulic fluid chambers is provided with hydraulic fluid pressure limiting means for establishing a maximum permissible grinding force for said adjustment means.

5. The roller mill of claim 1 wherein each of said pistons comprise annular plates.

6. The roller mill of claim 1 wherein each of said hydraulic fluid chambers is in communcation with a separate multi-way/multi-position valve means as well as a common hydraulic fluid pump and hydraulic fluid source all forming a part of said hydraulic fluid supply means.

7. The roller mill of claim 6 wherein said gas supply means includes a multi-way/multi-position valve means and a compressed gas source.

8. The roller mill of claim 7 wherein roller zero gap defining means are provided at each end of said other roller which function to move said other roller into a predetermined minimum gap relationship with said one roller when said spring is inoperative, said zero gap defining means including a further pneumatic spring having a container confining a further movable piston therein and in communication with both said gas and hydraulic fluid supply means on opposite sides of said further piston, the side of said further piston in communication with said hydraulic fluid supply means also being in communication with said at least one hydraulic working cylinder and one of said working pneumatic springs.

9. The roller mill of claim 1 wherein said gas supply means includes a multi-way/multi-position valve means and a compressed gas source.

10. The roller mill of claim 1 wherein said piston defining said other hydraulic fluid chamber is provided with a piston rod extending through its corresponding end of said container, said rod forming a part of said piston stroke measuring means.

11. The roller mill of claim 1 wherein said piston stroke measuring means includes an ultrasonic measuring device which responds to any movement of said piston defining said other hydraulic fluid chamber.

* * * * *